US007628618B2

(12) United States Patent
Wang et al.

(10) Patent No.: US 7,628,618 B2
(45) Date of Patent: Dec. 8, 2009

(54) FLEXIBLE CABLE POSITIONING DEVICE

(75) Inventors: Chien Chun Wang, Taoyuan (TW); Jing Heng Lin, Taoyuan (TW)

(73) Assignee: P-Two Industries, Inc. (TW)

( * ) Notice: Subject to any disclaimer, the term of this patent is extended or adjusted under 35 U.S.C. 154(b) by 0 days.

(21) Appl. No.: 12/082,847

(22) Filed: Apr. 15, 2008

(65) Prior Publication Data

US 2009/0137146 A1 May 28, 2009

(30) Foreign Application Priority Data

Nov. 28, 2007 (TW) ..... 96145089 A

(51) Int. Cl.
*H01R 12/00* (2006.01)

(52) U.S. Cl. ..... 439/67; 439/495

(58) Field of Classification Search ..... 439/67, 439/495, 490–494, 77

See application file for complete search history.

(56) References Cited

U.S. PATENT DOCUMENTS 4,934,946 A * 6/1990 Ordway ..... 439/77
5,752,851 A * 5/1998 Zaderej et al. ..... 439/493
7,374,430 B2 * 5/2008 Nagawatari ..... 439/67
2005/0042896 A1 * 2/2005 Huang ..... 439/67
2006/0110974 A1 * 5/2006 Suzuki et al. ..... 439/495
2008/0045076 A1 * 2/2008 Dittmann et al. ..... 439/495
2008/0233793 A1 * 9/2008 Ju ..... 439/493

* cited by examiner

*Primary Examiner*—Hien Vu
(74) *Attorney, Agent, or Firm*—Thomas W. Tolpin; Tolpin & Partners, PC

(57) ABSTRACT

A flexible cable positioning device is disclosed. The flexible cable positioning device comprises a baseboard, a positioning housing, a cover and a flexible cable. The baseboard has a plurality of contact points. The positioning housing is located on the baseboard and corresponded to the contact points. The cover is mounted on the positioning housing, and has a plurality of protruding parts corresponding to the contact points. The flexible cable is accommodated removably in the positioning housing, and the flexible cable has a contact part disposed between the contact points and the protruding parts. The cover is for pressing and fixing the flexible cable into the positioning housing, and the protruding parts are for fixing the contact part of the flexible cable to the contact points of the baseboard. Therefore, the contact part of the flexible cable is electrically connected with the contact points of the baseboard firmly and stably.

7 Claims, 5 Drawing Sheets

FLEXIBLE CABLE POSITIONING DEVICE

FIELD OF THE INVENTION

The present invention relates to a flexible cable positioning device, and more particularly to a flexible cable positioning device is manufactured by arranging a positioning housing and a cover on a baseboard, and using the positioning housing to limit a flexible cable on the baseboard, and further using the cover to press and fix the flexible cable to the baseboard, and such flexible cable positioning device can make the flexible cable firmly and stably electrically connect with the baseboard.

BACKGROUND OF THE INVENTION

In the electrical apparatus, such as cell phone and the camera, the internal components are gradually reduced the size and weight for fitting smaller, thinner and lighter structure design. In structure designs of the electronic devices, most contact terminals and connection wirings are electrically connected to the electric baseboard by welding. However, as the size of electrical apparatus becomes smaller and lighter, many electrical components and the size of wiring of are reduced significantly in order to fit the related electrical apparatus, such as cell phone.

For efficiently electrically connected to the electric baseboard, most connection wirings use flexible baseboard. While the flexible cable is usually used to connect with the electric baseboard, it is necessary to make flexible baseboard electrically connect to the surface of electric baseboard firmly and effectively in various conditions, so as to make flexible baseboard install on the electrical connector of electric baseboard.

In view of the drawbacks of the prior art, the inventor of the present invention based on years of experience in the related industry to conduct extensive researches and experiments, and finally developed a flexible cable positioning device in accordance with the present invention to overcome the aforementioned drawbacks.

SUMMARY OF THE INVENTION

One objective of the present invention is to provide a flexible cable positioning device. By disposing a positioning housing and a cover on an electric baseboard, and using the positioning housing, the flexible cable can be limited and accommodated in the positioning housing, and the contact part of the flexible cable can connect with the contact points of the baseboard efficiently. Furthermore, the cover can be rotated to press and fix the flexible cable on the baseboard. Therefore, the flexible cable positioning device of the present invention can make the flexible cable connect with the baseboard efficiently and enable the firm and stable connection between contact points and the contact part.

To achieve the objective mentioned above, the present invention provides a flexible cable positioning device comprising a baseboard, a positioning housing, a cover and a flexible cable. The baseboard has a plurality of contact points. the positioning housing is located on the baseboard and corresponding to the contact points. The cover is located on the positioning housing, and has a plurality of protruding parts corresponding to the contact points. The flexible cable is accommodated removably in the positioning housing, and has a contact part disposed between the contact points and the protruding parts. The cover is pressed for fixing the flexible cable in the positioning housing, and the protruding parts are used to fix the contact part of the flexible cable to the contact points of the baseboard, so as the contact part is electrically connected with the contact points.

To make it easier for our examiner to understand the objective of the invention, its structure, innovative features, and performance, we use preferred embodiments together with the attached drawings for the detailed description of the invention.

BRIEF DESCRIPTION OF THE DRAWINGS

The subject matter regarded as the invention is particularly pointed out and distinctly claimed in the concluding portion of the specification. The invention, both as to device and method of operation, together with features and advantages thereof may best be understood by reference to the following detailed description with the accompanying drawings in which:

BRIEF DESCRIPTION OF THE DRAWINGS

Please referring to FIG. 1 to FIG. 5 for a schematic diagram of an embodiment of the flexible cable positioning device in accordance with the present invention, the flexible cable positioning device comprises a baseboard 1, a positioning housing 2, a cover 3 and a flexible cable 4.

Figure 4:
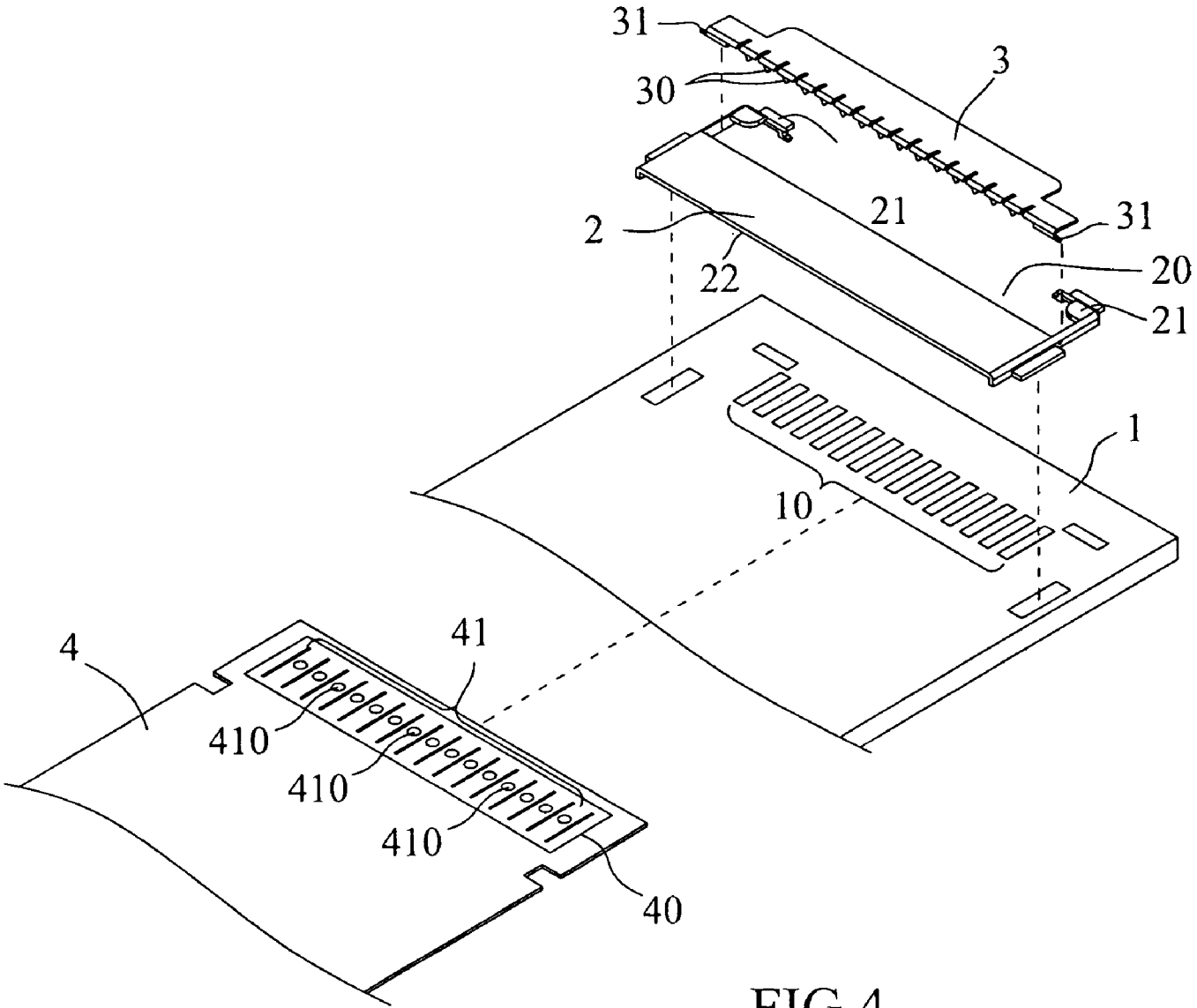
FIG. 4 illustrates an exploded view of the flexible cable positioning device of the present invention.

A plurality of contact points 10 are formed on the surface of the baseboard 1, as shown in FIG. 4, for making the baseboard 1 electrically connect with the flexible cable 4. The contact points 10 are arranged in spaced-apart in order. Preferably, the baseboard 1 is a printed circuit board (PCB).

The positioning housing 2 is fixed on the surface of the baseboard 1, and located above the contact points 10. The positioning housing 2 has a positioning space 20, and two positioning parts 21 corresponding to each other. An opening 22 is formed on one side surface of the positioning housing 2 for inserting the flexible cable 4. The positioning space 20 is formed at the inner surface of the positioning housing 2, and the positioning parts 21 are located on two sides of the positioning housing 2 and corresponding to the positioning space 20. The positioning parts 21 are formed by extending from the positioning housing 2. Therefore, both the positioning space 20 and the positioning parts 21 define a positioning enclosure therebetween for positioning the flexible cable 4.

In one embodiment, the positioning parts 21 are extended in parallel relatively to two sides of the positioning housing 2 to form an L-shape positioning enclosure. By the positioning parts 2, the flexible cable 4 can be accommodated in the positioning space 20 fixedly, and effectively positioned to the contact points 10 of the baseboard 1 for electrical connection. Preferably, the positioning housing 2 is fixed on the baseboard 1 by welding or assembled by bolt.

The cover 3 is movably mounted on the positioning housing 2, and located on the opposite side of the opening 22. In the embodiment, the cover 3 is rotatably mounted on the positioning parts 21 of the positioning housing 2 by pivoting. Besides, the cover 3 has a plurality of protruding parts 30, and two pivot parts 31 opposed to each other (as shown in FIG. 4).

Figure 1:
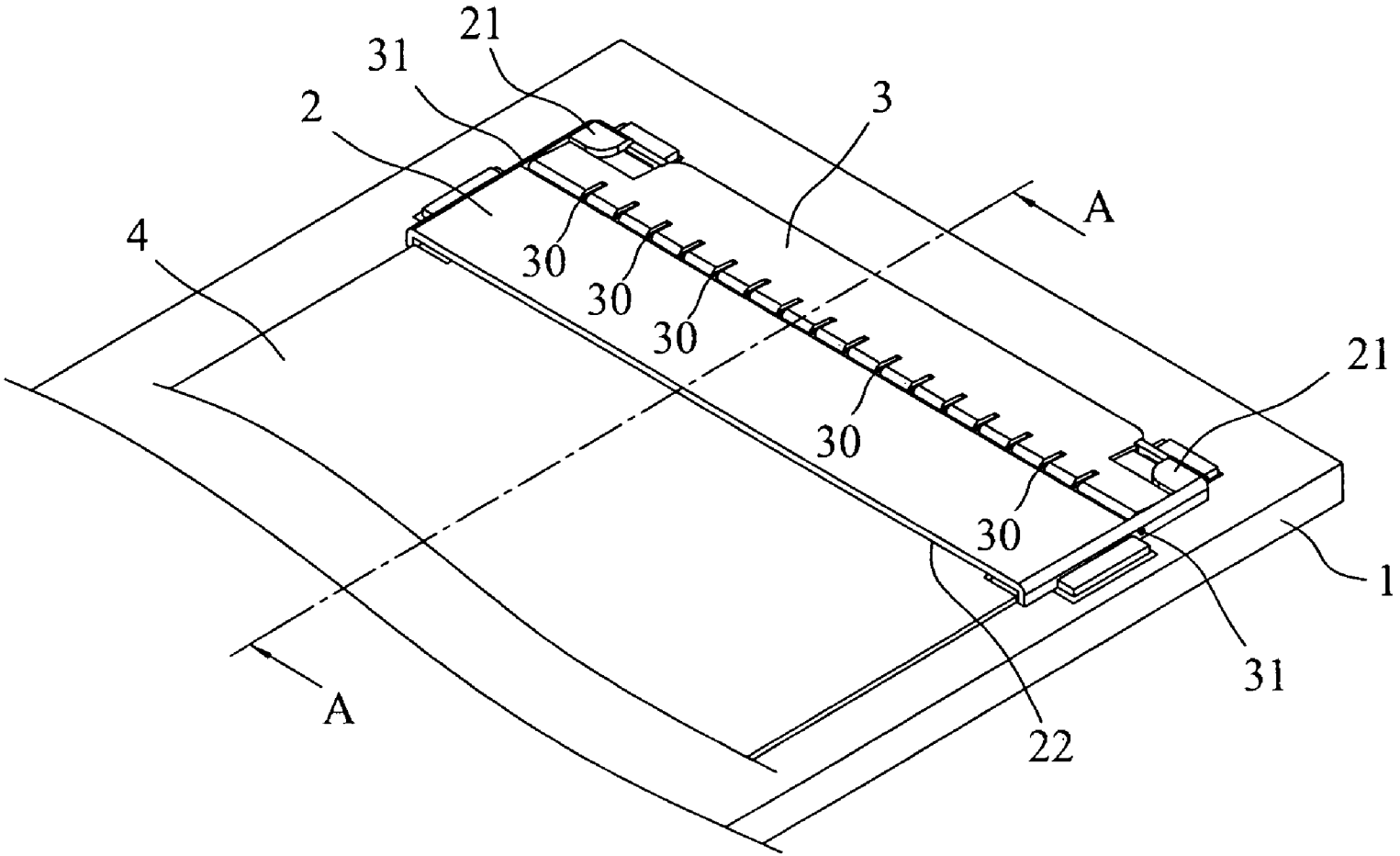
FIG. 1 illustrates a three-dimensional assembly diagram of the flexible cable positioning device of the present invention.
Figure 2:
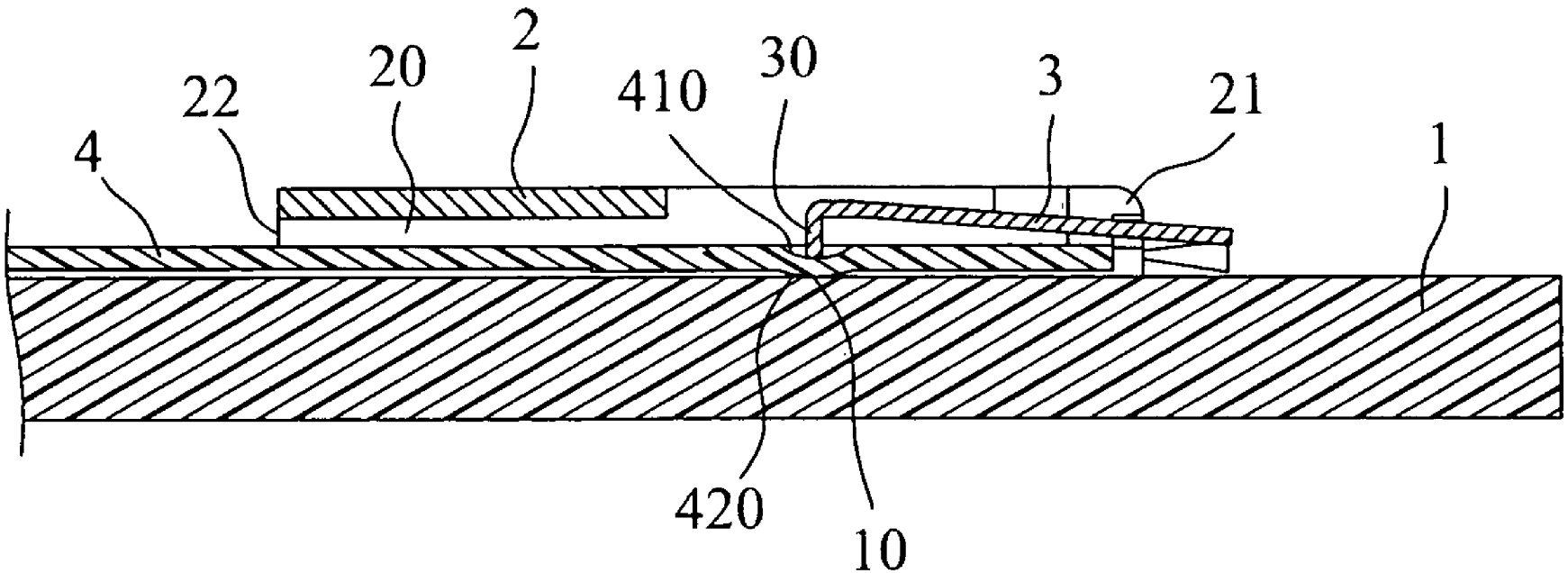
FIG. 2 illustrates a cross-section view of the flexible cable positioning device along the line A-A shown in FIG. 1.
Figure 3:
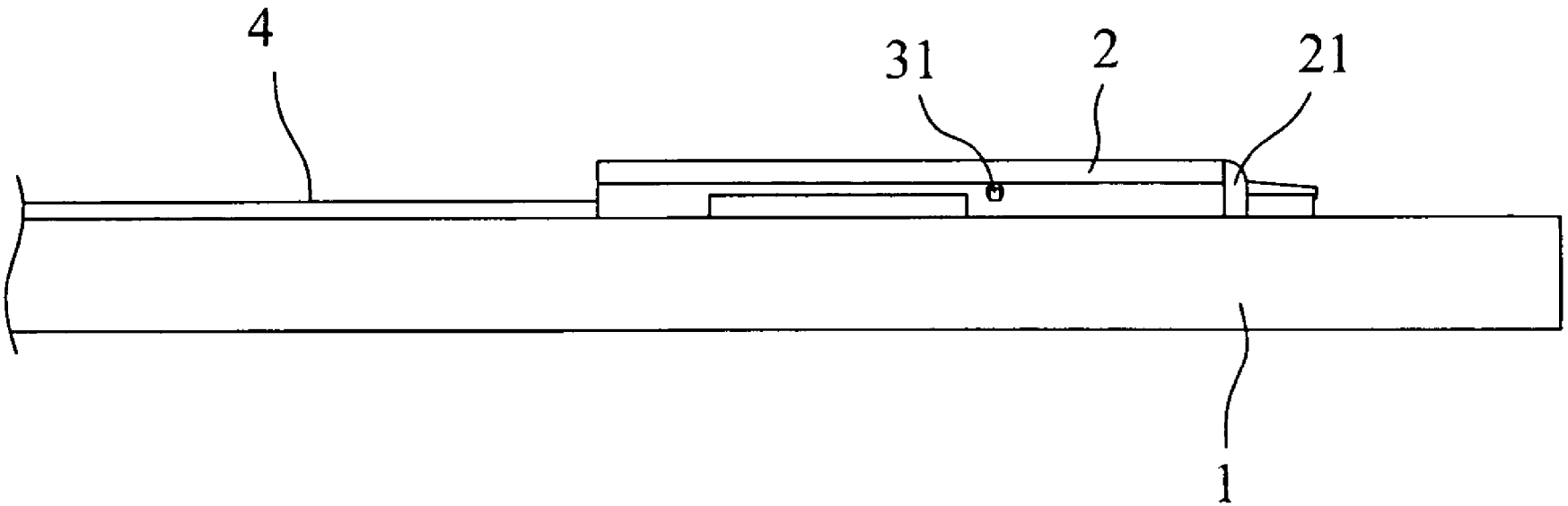
FIG. 3 illustrates a lateral view of the flexible cable positioning device of the present invention.

The protruding parts 30 are arranged at one side of the cover 3. Each of protruding parts 30 are curved and extended downwardly for corresponding to each of contact points 10 respectively (as shown in FIG. 2). The two pivot parts 31 are pivotally mounted on the positioning parts 21 for making the cover 3 rotate relatively to the positioning housing 2, and each of the protruding parts 30 can correspond to each of the contact points 10 respectively.

The flexible cable 4 is accommodated removably in the positioning housing 2. The flexible cable 4 has a contact part 40 which is formed in one end of the flexible cable 4. The contact part 40 of the flexible cable 4 is inserted into the positioning space 20 of the positioning housing 2, so that the contact part 40 is positioned between the contact points 10 of the baseboard 1 and the protruding parts 30 of the cover 3, and further electrically connects with the contact points 10 of the baseboard 1.

As mentioned above, when the contact part 40 of the flexible cable 4 is inserted into the positioning space 20, the cover 3 can be rotated relatively to positioning housing 2, for pressing and fixing the flexible cable 4 into the positioning housing 2, so as to electrically connect the flexible cable 4 with the contact points 10 of the baseboard 1 firmly and stably. Once the flexible cable 4 is loosed and moves toward the direction of the opening 22, due to the pivot position and design structure of the cover 3, the cover 3 will contact with the flexible cable 4 so that a counter force is generated to prevent the flexible cable 4 from being slipped off.

Figure 5:
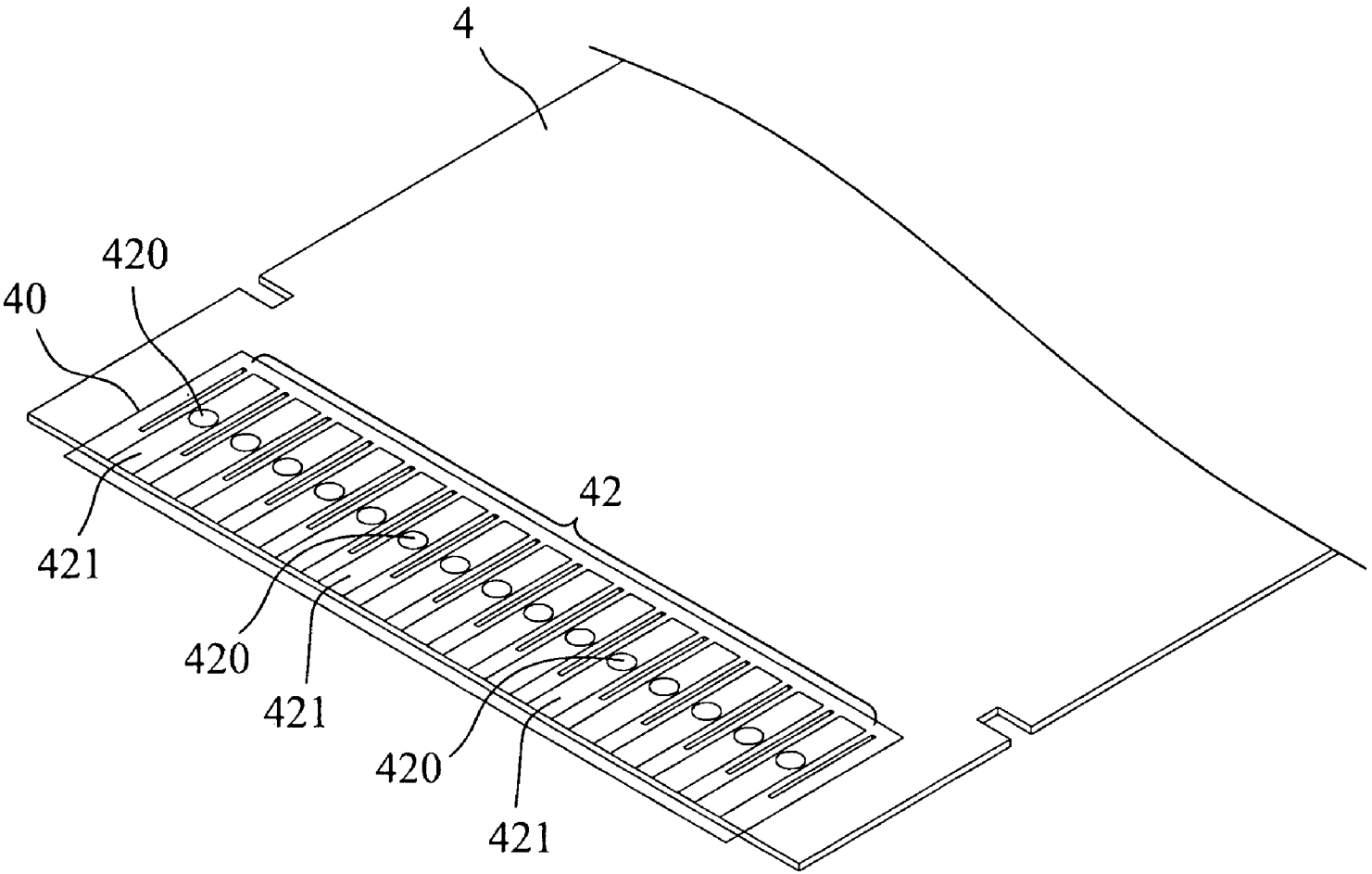
FIG. 5 illustrates a three-dimensional view of back side of the flexible cable positioning device of the present invention.

In one embodiment of the present invention, the flexible cable 4 can be a flat flexible cable. Besides, the contact part 40 further has a concave set 41 and a protruding set 42 (as shown in FIG. 4 and FIG. 5). The protruding set 42 and the concave set 41 are arranged on front side and reverse side of the flexible cable 4 respectively, and corresponding to each other. The concave set 41 has a plurality of concave points 410, and the protruding set 42 has a plurality of protruding points 420 and a plurality of terminal points 421. When the flexible cable 4 is accommodated in the positioning space 20, the concave points 410 of the concave set 41 of the contact part 40 are corresponding to the protruding parts 30, and the protruding points 420 and the terminal points 421 are corresponding to the contact points 10 of the baseboard 1. The cover 3 is then rotated to press and fix the flexible cable 4 for making the protruding parts 30 of the cover 3 contact with the concave points 410, so as to indirectly force the protruding points 420 and the terminal points 421 electrically connect with the contact points 10 of the baseboard 1 for keeping stable and firm electrical connection.

As illustrated in the design and employment of aforementioned structure, the flexible cable positioning device of the present invention has the following characteristics:

1. the flexible cable can be positioned in the positioning housing effectively when being accommodated in the positioning space, meanwhile, so that the contact part of the flexible cable can firmly contact the contact points of the baseboard.

2. By using cover to press and fix the flexible cable into the positioning housing, the contact part can electrically connect with the contact points firmly and stably.

3. By pivotally mounting the cover in the opposite side of the opening, the flexible cable would wedge with the cover 3 to provide a counter force to against the flexible cable from being slipped off while flexible cable accidentally loosed and moved toward the direction of the opening.

While the present invention has been described by way of example and in terms of a preferred embodiment, it is to be understood that the present invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flexible cable positioning device comprising:

a baseboard, having a plurality of contact points;

a positioning housing, located on said baseboard and corresponding to said contact points, and having an opening thereon;

a cover, movably mounted on said positioning housing, and having a plurality of protruding parts corresponding to said contact points; and a flexible cable, inserted into said positioning housing via said opening and accommodated in said positioning housing, and having a contact part disposed between said contact points and said protruding parts;

said cover being mounted on said positioning housing and located on the side opposite to said opening, said cover pressing and fixing said flexible cable into said positioning housing, and said protruding parts of said cover fixing said contact part of said flexible cable on said contact points of said baseboard to make said contact part electrically connect with said contact points such that once said flexible cable is loosened and moved toward the direction of the opening of the positioning housing, said cover will contact said flexible cable so that a counter force is generated to prevent said flexible cable from being slipped off;

wherein said positioning housing has two positioning parts located and spaced away on each side of a rear end of said positioning housing respectively, and said positioning parts are used for limiting said contact part of said flexible cable to contact said contact points of said baseboard correspondingly; and wherein said cover comprises a rotatable cover with two pivot parts opposed to each other and pivotally mounted on said positioning parts of said positioning housing, so that said rotatable cover can rotatably to press and fix said flexible cable into said positioning housing when a front portion of said cover being at closed position and adjacent to said rear end of said positioning housing.

2. The flexible cable positioning device of claim 1, wherein said baseboard is a printed circuit board (PCB), and said contact points are formed on the surface of said baseboard.

3. The flexible cable positioning device of claim 1, wherein said positioning housing is fixed on said baseboard and located above said contact points, and has a positioning space for accommodating said flexible cable.

4. The flexible cable positioning device of claim 1, wherein said positioning housing is fixed on said baseboard by welding.

5. The flexible cable positioning device of claim 1, wherein said positioning housing is assembly fixed on said baseboard and located above said contact points, which has a positioning space for accommodating said flexible cable.

6. The flexible cable positioning device of claim 1, wherein said contact part of said flexible cable comprises a protruding set and a concave set, and said protruding set and said concave set are formed on the front side and reverse side of said flexible cable respectively and opposed to each other.

7. The flexible cable positioning device of claim 6, wherein said concave set comprises a plurality of concave point, and said protruding set comprises a plurality of protruding points and a plurality of terminal points, and said protruding points and said terminal points are electrically connected with said contact points of said baseboard.

* * * * *